US008680388B2

(12) United States Patent
Becker et al.

(10) Patent No.: US 8,680,388 B2
(45) Date of Patent: Mar. 25, 2014

(54) AUTOMATIC RECOGNITION AND MATCHING OF TEMPO AND PHASE OF PIECES OF MUSIC, AND AN INTERACTIVE MUSIC PLAYER

(75) Inventors: Friedemann Becker, Osterholz-Schambeck (DE); Thomas Holl, Karlsruhe (DE); Michael Kurz, Berlin (DE); Toine Diepstraten, Berlin (DE); Daniel Haver, Berlin (DE)

(73) Assignee: Native Instruments Software Synthesis GmbH, Berlin (DE)

( * ) Notice: Subject to any disclaimer, the term of this patent is extended or adjusted under 35 U.S.C. 154(b) by 283 days.

(21) Appl. No.: 12/565,766

(22) Filed: Sep. 24, 2009

(65) Prior Publication Data

US 2010/0011941 A1 Jan. 21, 2010

Related U.S. Application Data

(63) Continuation of application No. 10/251,000, filed as application No. PCT/EP02/00074 on Jan. 7, 2002, now Pat. No. 7,615,702.

(30) Foreign Application Priority Data

Jan. 13, 2001 (DE) ..... 101 01 473

(51) Int. Cl.
*G10H 1/08* (2006.01)

(52) U.S. Cl.
USPC ..... 84/625; 84/609; 84/612; 84/622; 84/649; 84/652; 84/659; 84/660

(58) Field of Classification Search
None
See application file for complete search history.

(56) References Cited

U.S. PATENT DOCUMENTS

| | | | | |
|---|---|---|---|---|
| 5,336,844 | A * | 8/1994 | Yamauchi et al. | 84/602 |
| 5,683,253 | A * | 11/1997 | Park et al. | 434/307 A |
| 5,793,739 | A * | 8/1998 | Tanaka et al. | 369/124.14 |
| 7,041,892 | B2 * | 5/2006 | Becker | 84/603 |
| 7,058,882 | B2 * | 6/2006 | Kobayashi | 715/204 |
| 7,169,999 | B2 * | 1/2007 | Tsuji et al. | 84/645 |
| 7,319,185 | B1 * | 1/2008 | Wieder | 84/609 |
| 7,615,702 | B2 * | 11/2009 | Becker et al. | 84/612 |
| 7,732,697 | B1 * | 6/2010 | Wieder | 84/609 |
| 2001/0017076 | A1 * | 8/2001 | Fujita et al. | 84/603 |
| 2004/0069123 | A1 * | 4/2004 | Becker et al. | 84/612 |
| 2004/0177746 | A1 * | 9/2004 | Becker | 84/612 |
| 2004/0177747 | A1 * | 9/2004 | Tsuji et al. | 84/645 |
| 2009/0019995 | A1 * | 1/2009 | Miyajima | 84/625 |
| 2009/0223352 | A1 * | 9/2009 | Matsuda et al. | 84/612 |
| 2009/0272253 | A1 * | 11/2009 | Yamashita et al. | 84/611 |
| 2010/0011941 | A1 * | 1/2010 | Becker et al. | 84/612 |

* cited by examiner

*Primary Examiner* — Marlon Fletcher
(74) *Attorney, Agent, or Firm* — Aaron Wininger; Perkins Coie LLP

(57) ABSTRACT

A method of matching the tempo and phase in pieces of music which allows the conjunction of the pieces of music to form a continuous stream of music. The interactive music player which digitally executes the method of matching the tempo and phase in pieces of music is also disclosed.

37 Claims, 4 Drawing Sheets

AUTOMATIC RECOGNITION AND MATCHING OF TEMPO AND PHASE OF PIECES OF MUSIC, AND AN INTERACTIVE MUSIC PLAYER

This application is a continuation of U.S. patent application Ser. No. 10/251,000 filed Jul. 8, 2003, which is a national phase entry of PCT/EP02/00074 filed Jan. 7, 2002, which claims priority to DE 101 01 4 73.2 filed Jan. 13, 2001, all of which are incorporated by reference.

FIELD OF THE INVENTION

The invention is based on the detection and matching of tempo and phase in pieces of music, especially for the realisation of an interactive music player, which amongst other advantages, allows several synchronised pieces of music to be played back to form a complete new work. In this context, digital music data are obtained, according to one advantageous embodiment, by a playing back several pieces of music at the same time on a standard CD-ROM drive in real-time.

BACKGROUND

In present-day dance culture, which is characterised by modern, electronic music, the technical demands on the disc jockey (DJ) have increased to a considerable extent. Sorting the pieces of music to be played to form a complete work with its own characteristic curve of emotional excitement (referred to as a set or a mix) is one of the standard tasks required of a DJ. In this context, it is important to be able to match the individual pieces of music with reference to their tempo and the phase, in other words, the position of the beats in the time grid, (referred to in English as "beat matching"), in such a manner that the pieces of music merge in a unified manner at the transition points without interrupting the rhythm.

This requirement presents the technical problem of tempo and phase matching of two pieces of music and/or audio tracks in real-time. Accordingly, it would be desirable if the tempo and phase of two pieces of music and/or audio tracks could be matched automatically in real-time, in order to release the DJ from this technical aspect of mixing, and/or to create a mix automatically or semi-automatically, without the assistance of a technically skilled DJ.

So far, this problem has only been addressed in an incomplete manner. For example, software players are available for the MP3 format (a standard format for compressed digital audio data), which can realise pure, real-time tempo detection and matching. However, phase detection must still be carried out manually on the basis of the listening and matching skills of the DJ. This demands a considerable amount of the DJ's attention, which would otherwise be available for more artistic aspects such as compiling the music etc.

Hardware effects-equipment for processing audio information, which can indeed realise real-time tempo and phase detection is also already known, but this equipment cannot match the tempo and phase of the audio material, if the data have only been supplied in analogue form. The equipment can only provide a visual display of the relative phase shift of the two audio tracks.

However, no devices are currently known which utilise tempo information to calculate loops (short audio segments, which can be played back repeatedly) and loop lengths. With the previously used playback equipment, these are either cut and loaded in advance (software MP3 player) or set and matched manually (hardware CD player).

SUMMARY

Accordingly, one object of the present invention is to create the possibility for automatic tempo and phase matching of two pieces of music and/or audio tracks in real-time with the greatest possible accuracy.

One substantial technical problem here is the accuracy of tempo and phase measurement, which declines in direct proportion to the time available for measurement. The primary problem is therefore to establish the tempo and phase in real-time, as, for example, in the case of live mixing.

According to the present invention this object is achieved with a method for detecting the tempo and phase of a piece of music available in digital format comprising the following procedural stages:

- approximation of the tempo of the piece of music by means of a statistical evaluation of the time intervals between rhythm-relevant beat information in the digital audio data,
- approximation of the phase of the piece of music with reference to the position of the beats in the digital audio data in the time grid of a reference oscillator oscillating at a frequency proportional to the established tempo,
- successive correction of the established tempo and phase of the piece of music with reference to a possible phase shift of the reference oscillator relative to the digital audio data by evaluating the resulting, systematic phase shift and regulating the frequency of the reference oscillator in proportion to the phase shift established.

A successive approximation to the ideal value is therefore implemented in a control circuit.

In this context, it has proved favourable, if rhythm-relevant beat information is obtained through the band-pass filtering of the underlying digital audio data in various frequency ranges.

This is particularly successful if rhythm intervals in the audio data are transformed, if necessary by raising their frequency by a power of two, into a pre-defined frequency octave, where they provide time intervals for establishing the tempo. Further relevant intervals can be obtained if the rhythm intervals are grouped, especially in pairs or groups of three, by addition of their time values, before the frequency transformation.

According to one advantageous embodiment, the quantity of data obtained which refers to time intervals in the rhythm-relevant beat information is investigated for accumulation points. The tempo approximation is then based on the information regarding the accumulation maximum.

According to one further, advantageous embodiment of the method according to the present invention, the phase of the reference oscillator for establishing the approximate phase of the piece of music is selected in such a manner that the maximum agreement is achieved between the rhythm-relevant beat-information in the digital audio data and the zero passes of the reference oscillator.

Furthermore, it has proved favourable if a successive correction of the established tempo and phase of the piece of music is carried out at regular intervals in such short time intervals that resulting correction movements and/or correction shifts remain below the threshold of audibility.

Since all the successive corrections of the established tempo and phase in the piece of music are accumulated over time, further-corrections can be made on this basis with constantly increasing accuracy.

Instead of implementing successive corrections of this kind continuously, corrections may alternatively be implemented until the volume of errors falls below a tolerable error threshold. In this context, an error threshold of less than 0.1% is suitable for the tempo established.

If the corrections are always exclusively either negative or positive over a predetermined period, a new approximation of tempo and phase with subsequent, successive corrections is carried out to ensure that any possible tempo changes in the piece of music are matched.

In addition to the automatic detection of tempo and phase in pieces of music, as described above, the specified object also requires a matching of tempo and phase in the pieces of music.

This problem is resolved, in that, after an initial approximation of the tempo and phase of the pieces of music, these results and the matching are successively improved on the basis of feedback to the playback rate of the piece of music.

According to the invention, this is achieved with a method for synchronising at least two pieces of music available in digital format with the following procedural steps:

- complete establishment of tempo and phase of the first piece of music as described above,
- approximation of tempo and phase of the other piece of music as described above,
- matching of the playback rate and the playback phase of the other piece of music by successively matching the frequency and phase of the reference oscillator allocated to the other piece of music to the frequency and phase of the reference oscillator allocated to the first piece of music.

In this context, it has proved advantageous if the playback rate and the playback phase of the other piece of music is matched on the basis of a possible phase shift of the reference oscillator allocated to this other piece of music relative to the reference oscillator allocated to the first piece of music, the resulting systematic phase shift is evaluated and the frequency of the reference oscillator allocated to the other piece of music is regulated in proportion to the phase shift established.

A successive approximation to the ideal value is therefore carried out in a control circuit, in which the tempo and phase information are fed back into the control unit for the playback speed of the audio material.

Various devices for various storage media such as vinyl discs, CDs or cassettes are currently used for playing back pre-recorded music. These formats were not developed to allow interventions during the playback process, wherein the music can be processed in a creative manner. However, this possibility is not only desirable; it is already practised by the disc jockeys mentioned in the introduction in spite of the limitations encountered. Vinyl discs are preferred, because manual influence on the playback rate and playback position can most readily be achieved in this context.

Nowadays, however, digital formats such as audio CD and MP3 are predominantly used for storing music. The present invention allows the possibility of creative processing of music, as described above, in the context of any digital format required.

With the method according to the invention as described above, it is possible to produce a mix in a fully automatic manner from a collection of pieces of music, wherein the pieces of music are placed in sequence with the correct tempo and phase.

This is achieved with a music player, wherein at least two pieces of music available in digital format can be synchronised in real-time as explained above.

Particularly effective results are obtained with a music player wherein, in each case starting from a current playback position of the piece of music, rhythm-relevant beat information for a predetermined past time are used as the basis for establishing the tempo.

As a result of the automatic tempo detection, the content of a music data source, e.g. a CD, can be played back, at the request of the listener, as a homogeneous mix providing a tempo-dependent sequence, which the listener can select.

The invention therefore also comprises a music player of this kind, wherein the synchronised pieces of music can be sorted and played back automatically to form a complete work with unified rhythm.

To implement targeted interventions, it is important to have a graphic representation of the music, which allows the identification of the current playback position as well as a given period in the future and in the past. For this purpose, it is conventional to present the amplitude-envelope-curve of the sound-wave form over a period of several seconds before and after the playback position. The display moves in real-time at the rate at which the music is played.

In this context, it is essential to have as much helpful information in the graphic representation as possible, in order to make the interventions in a targeted manner. It would also be desirable to be able to intervene in the playback procedure in an ergonomic manner, comparable to the "scratching" frequently practised by DJs with vinyl disc players, holding the turntable and moving it forwards and backwards during playback.

To resolve this problem, the present invention proposes an interactive music player, which provides

- a means for graphic representation of given beat thresholds in a piece of music being played back in real-time with a tempo and phase detection function, especially as described above,
- a first control element for changing between a first operating mode in which the piece of music is played back at a constant tempo, and a second operating mode in which the playback position and/or playback rate can be directly influenced by the user in real-time, and
- a second control element for manipulating the playback position in real-time.

According to one advantageous embodiment, this interactive player is additionally fitted with:

- a means for graphic representation of the current playback position, which represents an amplitude-envelope-curve of the sound-wave form of the piece of music being played, with a predetermined period before and after the current playback position, wherein the representation in real-time moves at the playback tempo of the piece of music, and with
- a means for smoothing a stepped sequence of time-limited playback-position-data predetermined by the second control element to form a uniformly-changing signal with a time resolution corresponding to the audio sampling rate.

In this context, it has proved advantageous if a means for ramp smoothing is provided for smoothing a stepped sequence of time-limited playback-position-data, by means of which a ramp with constant gradient can be resolved with every predetermined playback position message, which, within a predetermined time interval, moves the smoothed signal from its previous value to the value of the playback position message. Alternatively, or additionally, a linear, digital low-pass filter, especially a second-order resonance filter, can be used for smoothing a stepped sequence of predetermined time-limited playback-position-data.

To avoid jumps in playback when switching between operating modes, the position reached in the previous mode is used as the starting position in the new mode.

To avoid abrupt changes in the playback rate when switching between operating modes, the current playback rate reached in the previous mode is moved by a smoothing function, especially a ramp-smoothing function or a linear, digital low-pass filter, to a playback rate corresponding to the playback rate in the new operating mode.

When playing back with very strongly and quickly changing playback rates, a playback which most authentically resembles "scratching" on a vinyl disc player can be achieved with a further advantageous embodiment of the interactive music player according to the invention which uses a scratch-audio-filter for an audio signal, wherein the audio signal is subjected to pre-emphasis filtering (pre-distortion) and stored in a buffer memory, from which it can be read out at a variable tempo in dependence on the relevant playback rate, after which it is subjected to de-emphasis filtering (reverse-distortion) before playing back.

The length of one or more beats can be established on the basis of the tempo information with sufficient accuracy to set the length of a loop at the touch of a button, so that the loop can be played without "clicks" at the tempo of the original audio track. According to a further advantageous embodiment of an interactive music player of this kind, which establishes tempo information in the manner described according to the invention, it is possible, on the basis of the tempo information established for one or more of the synchronised pieces of music, to define the length of a playback loop in the relevant piece of music extending over one or more beats of this piece of music and to play back the loop in a beat-synchronised manner in real-time.

In this context, the phase information can be used, once again at the touch of a button, to place jump marks, or so-called cue-points within the track, or to place entire loops accurately on a starting beat. An advantageous interactive music player can therefore be further developed in that, for one or more of the synchronised pieces of music and with reference to the established phase information from the relevant piece of music, beat-synchronised jump marks can be defined in real-time and can be moved within this piece of music by whole number multiples of beats. Such cue-points and loops can also be moved by whole number multiples of beats within the track. Both procedures are carried out in real-time, during the playback of the audio track.

Furthermore, the information obtained about the tempo and phase of an audio track allows so-called tempo-synchronised effects to be controlled. In this context, the audio signal is manipulated to match its own rhythm, which allows rhythmically effective, real-time sound changes. In particular, the tempo information can be used to cut loops from the audio material in real-time with a length synchronised to the beat.

A further advantageous interactive music player is characterised in that each audio-data stream played back can be manipulated in real-time by signal processing means, in particular, by means of filter equipment and/or audio effects.

When mixing several pieces of music, the audio sources from sound media are conventionally played back on several playback devices, for example, vinyl-disc players or CD players and then mixed via a mixing desk. With this procedure, audio recording is restricted to recording the final results. When using computer systems with audio interfaces and appropriate audio-processing software, such as audio sequencers or so-called sample processing programs for manipulating digital audio information, interactive interventions by the user are not possible during playback.

If the mixing procedure is to be reproduced or if mixing is to be continued at a later time accurately from a predetermined position within a piece of music, it would be desirable to play back not only the final result.

This object is achieved according to the invention with an interactive music player, which is further developed so that real-time interventions, especially interventions from a mixing procedure with several pieces of music and/or additional signal processing, can be stored over the time sequence as digital control information.

Since mixing procedures with pieces of music and/or interactive interventions into pieces of music using audio-signal processing media can be stored as a complete new work independently from the digital audio information in the piece of music, in the form of digital control information, especially for the purpose of reproduction, the processes of interactive mixing and interactive effect processing can be recorded and played back at any time.

According to a further advantageous embodiment of the invention, stored digital control information has a format which provides information for the identification of the processed pieces of music and a time sequence of playback positions and status information for the control elements of the music player allocated to each of these.

One decisive advantage of this recording option and of the proposed format is the fact that a digital record of the mixing procedure can be implemented independently from the audio data in the pieces of music mixed; this therefore avoids the problems with reference to copyright associated with copying these audio data. The overall result can therefore be played back, processed, duplicated and transmitted independently at any time.

One particularly advantageous interactive music player can be realised with an appropriately programmed computer system fitted with audio interfaces. In this context, standard data storage media of the computer system are used for recording the control file. A particularly interesting transfer of recording files, which are generally not memory-intensive, can therefore also be realised, for example, via the Internet.

This poses the problem that often only one audio data source is available, for example, a CD player or, in the case of a computer system, a CD-ROM drive. In general, these and other playback devices have only a single reader unit at their disposal. However, to implement the function described above, in particular, the mixing of several pieces of music, the audio data from at least two pieces of music must be available at the same time. It would therefore be desirable if this could be achieved with one playback device with only one reader unit.

The invention resolves this problem with a method for providing in real-time digital audio data from at least two pieces of music from a data source with only one reader unit, provided the data source supplies the audio data at a reading rate faster than the playback rate, in that an appropriate buffer memory, especially a ring-buffer memory, is provided for each piece of music to be played back, and the faster reading rate is used to fill the relevant buffer memories with the relevant audio data in such a manner that audio data are always available chronologically before and after a current playback position in the relevant piece of music.

In this context, it has also proved advantageous to monitor the status of each buffer memory to determine whether adequate data are available and, if the level of data falls below a predetermined threshold value, to order a central instance, which is not coupled to the playback of the pieces of music, to provide the necessary audio data, wherein the central instance automatically requests the necessary regions of audio data from the data source and fills the relevant buffer memory with the data obtained. According to a further advantageous embodiment, data no longer needed are over-written during the filling of a buffer memory. Moreover, it has proved advantageous if the central instance sorts requests received in parallel into an order to be worked through sequentially.

This method is particularly suitable in conjunction with a CD-ROM drive and presents an innovative and advantageous method of reading from such drives in a manner referred to by a person skilled in the art as CD-grabbing. In a further advantageous, interactive music player, a CD-ROM drive operated according to the method described above can be used as the data source for pieces of music.

Since the invention described above can be realised in a particularly advantageous manner with an appropriately programmed computer system, the measures according to the invention can also be realised in the form of a computer software product, which can be loaded directly into the internal memory of a digital computer and comprises software sections, with which the measures according to the invention can be implemented, when the software product is run on a computer.

In this context, the invention also allows the provision of a data medium, especially a compact disc, with

- a first data region with digital audio data from one or more piece of music and
- a second data region with a control file with digital control information for controlling a music player, especially a music player as described above, wherein
- the control data in the second data region refer to audio data in the first data region.

In this context, it is particularly advantageous if the digital control information in the second data region represent mixing procedures with pieces of music and/or interactive interventions into pieces of music with audio signal processing media as a new complete work of the digital audio information from pieces of music in the first data region.

Furthermore, it has proved favourable if the stored digital control information in the second data region has a format, which provides the information for identifying the processed pieces of music in the first data region as well as the relevant time sequence of playback positions and status information for the control elements in the music player allocated to each piece of music.

It is also advantageously possible to arrange on a data medium of this kind, a computer software product, which can be loaded directly into the internal memory of a digital computer and provides software sections, which allow this digital computer to function as a music player, in particular, a music player as described above, which, on the basis of the control data in the second data region of the data medium, which refer to audio data in the first data region of the data medium, can play back a complete work represented by the control data when the software product is run on the computer.

Since the interactive music player combines audio playback, signal analysis and signal transformation by means of effects and loops, it is possible, for the first time, not only to realise the real-time detection of the tempo and phase of the audio track but at the same time also to achieve automatic matching of tempo and phase.

The analysis additionally provides necessary output data for the control of tempo-synchronised effects and loops.

The advantages include, amongst others, the possibility of automating the so-called beat-matching process achieved in this context, a basic requirement for DJ mixing which cannot be readily learned, and which claims a considerable amount of the DJ's attention at every transition between two pieces of music. Furthermore, the entire mixing procedure can be automated.

BRIEF DESCRIPTION OF THE DRAWINGS

Further advantages and details of the invention are provided with reference to the following description of advantageous exemplary embodiments in conjunction with the drawings. In outline, the drawings are as follows.

DETAILED DESCRIPTION

Figure 1:
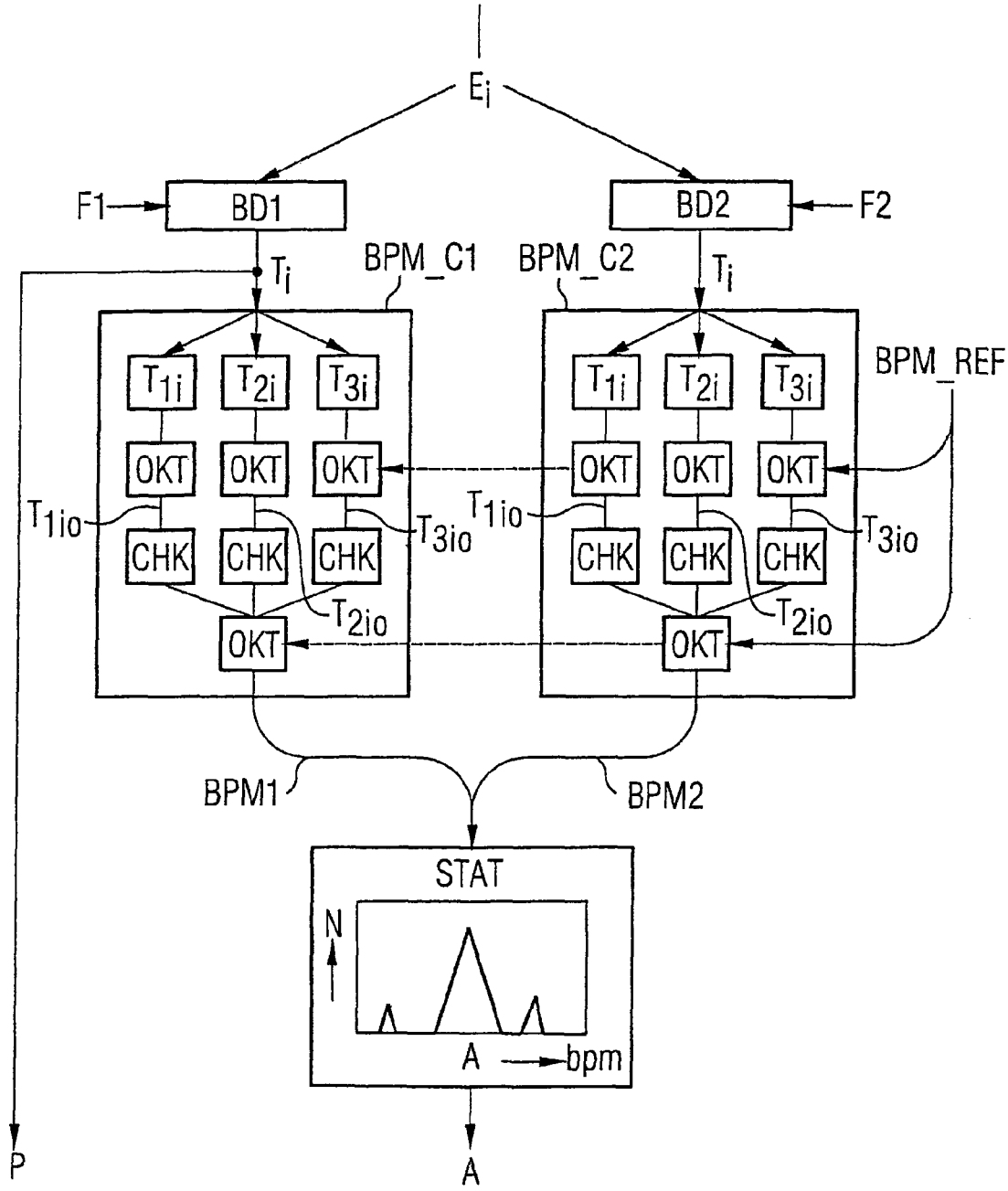
FIG. 1 shows a block circuit diagram to illustrate the acquisition of rhythm-relevant information and its evaluation for the approximation of tempo and phase in a music data stream.

The following description is intended to represent a possible realisation of the approximate tempo and phase detection and tempo and phase matching according to the invention.

The first stage of the procedure is an initial, approximation of the tempo of the piece of music. This is implemented via a statistical evaluation of the time interval between the so-called beat-events. One method for obtaining rhythm-relevant events from the audio material is to use a narrow band-pass filter for audio signals in various frequency ranges. To establish the tempo in real-time, only beat events from the preceding few seconds are used for the subsequent calculations in each case. Accordingly, 8 to 16 events correspond approximately to 4 to 8 seconds.

In view of the quantised structure of music ($16^{th}$ note grid), it is possible to include not only quarter note beat intervals in the tempo calculation; other intervals ($16^{th}$, $8^{th}$, ½ and whole notes) can be transformed, by means of octaving (that is, raising their frequency by a power of two), into a pre-defined frequency octave (e.g. 90-160 bpm=beats per minute) and thereby supplying tempo-relevant information. Errors in octaving (e.g. of triplet intervals) are not relevant for the subsequent statistical evaluation because of their relative rarity.

In order to register triplets and/or shuffled rhythms (individual notes displaced slightly from the $16^{th}$ note grid), the time intervals obtained at the first point are additionally grouped into pairs and groups of three by addition of the time values before they are octaved. The rhythmic structure between beats is calculated from the time intervals using this method.

The quantity of data obtained in this manner is investigated for accumulation points. In general, depending on the octaving and grouping procedure, three accumulation maxima occur, of which the values are in a rational relationship to one another (2/3, 5/4, 4/5 or 3/2). If it is not sufficiently clear from the strength of one of the maxima that this indicates the actual tempo of the piece of music, the correct maximum can be established from the rational relationships between the maxima.

A reference oscillator is used for approximation of the phase. This oscillates at the tempo previously established. Its phase is advantageously selected to achieve the best agreement between beat-events in the audio material and zero passes of the oscillator.

Following this, a successive improvement of the approximated tempo and phase is implemented. As a result of the natural inaccuracy of the initial tempo approximation, the phase of the reference oscillator is initially shifted relative to the audio track after a few seconds. This systematic phase shift provides information about the amount by which the tempo of the reference oscillator must be changed. A correction of the tempo and phase is advantageously carried out at regular intervals, in order to remain below the threshold of audibility of the shifts and correction movements.

All of the phase corrections, implemented from the time of the approximate phase correlation, are accumulated over time so that the calculation of the tempo and the phase is based on a constantly increasing time interval. As a result, the tempo and phase values become increasingly more accurate and lose the error associated with approximate real-time measurements mentioned above. After a short time (approximately 1 minute), the error in the tempo value obtained by this method falls below 0.1%, a measure of accuracy, which is a prerequisite for calculating loop lengths.

The drawing according to FIG. 1 shows a possible technical realisation of the approximate tempo and phase detection in a music data stream in real-time on the basis of a block circuit diagram. The set-up shown can also be described as a "beat detector".

Two streams of audio events $E_i$ with a value 1 are provided as the input; these correspond to the peaks in the frequency bands F1 at 150 Hz and F2 at 4000 Hz or 9000 Hz. These two event streams are initially processed separately, being filtered through appropriate band-pass filters with threshold frequency F1 and F2 in each case.

If an event follows the preceding event within 50 ms, the second event is ignored. A time of 50 ms corresponds to the duration of a $16^{th}$ note at 300 bpm, and is therefore considerably shorter than the duration of the shortest interval in which the pieces of music are generally located.

From the stream of filtered events $E_i$, a stream consisting of the simple time intervals $T_i$ between the events is now calculated in the relevant processing units BD1 and BD2.

Two further streams of bandwidth-limited time intervals are additionally formed in identical processing units BPM_C1 and BPM_C2 in each case from the stream of simple time intervals $T_{1i}$: namely, the sums of two successive time intervals in each case with time intervals $T_{2i}$, and the sum of three successive time intervals with time intervals $T_{3i}$. The events included in this context may also overlap. Accordingly from the stream: $t_1, t_2, t_3, t_4, t_5, t_6 \ldots$ the following two streams are additionally produced:

$$T_{2i}:(t_1+t_2),(t_2+t_3),(t_3+t_4),(t_4+t_5),(t_5+t_6), \ldots$$

and $$T_{3i}:(t_1+t_2+t_3),(t_2+t_3+t_4),(t_3+t_4+t_5),(t_4+t_5+t_6) \ldots$$

The three streams $\ldots T_{1i}, T_{2i}, T_{3i}$, are now time-octaved in appropriate processing units OKT. The time-octaving OKT is implemented in such a manner that the individual time intervals of each stream are doubled until they lie within a predetermined interval BPM_REF. Three data streams $T_{1io}$, $T_{2io}$, $T_{3io}$ are obtained in this manner. The upper limit of the interval is calculated from the lower bpm threshold according to the formula:

$$t_{hi}[ms]=60000/\mathrm{bpm}_{low}.$$

The lower threshold of the interval is approximately 0.5* $t_{hi}$

The consistency of each of the three streams obtained in this manner is now checked, in further processing units CHK, for the two frequency bands F1, F2. This determines whether a certain number of successive, time-octaved interval values lie within a predetermined error threshold in each case. In particular, this check may be carried out, with the following values:

For $T_{1i}$, the last 4 relevant events $t_{11o}$, $t_{12o}$, $t_{13o}$, $t_{14o}$ are checked to determine whether the following applies:

$$(t_{11o}-t_{12o})^2+(t_{11o}-t_{13o})^2+(t_{11o}-t_{14o})^2<20 \quad \text{a)}$$

If this is the case, the value $t_{110}$ will be obtained as a valid time interval.

For $T_{2i}$, the last 4 relevant events $t_{21o}$, $t_{22o}$, $t_{23o}$, $t_{24o}$ are checked to determine whether the following applies:

$$(t_{21o}-t_{22o})^2+(t_{21o}-t_{23o})^2+(t_{21o}-t_{24o})^2<20 \quad \text{b)}$$

If this is the case, the value $t_{210}$ will be obtained as a valid time interval.

For $T_{3i}$, the last 4 relevant events $t_{31o}$, $t_{32o}$, $t_{33o}$, $t_{34o}$ are checked to determine whether the following applies:

$$(t_{31o}-t_{32o})^2+(t_{31o}-t_{33o})^2+(t_{31o}-t_{34o})^2<20 \quad \text{c)}$$

If this is the case, the value $t_{310}$ will be obtained as a valid time interval.

In this context, consistency test a) takes priority over b), and b) takes priority over c). Accordingly, if a value is obtained for a), then b) and c) will not be investigated. If no value is obtained for a), then b) will be investigated and so on. However, if a consistent value is not found for a), or for b) or for c), then the sum of the last 4 non-octaved individual intervals ($t_1+t_2+t_3+t_4$) will be obtained.

The stream of values for consistent time intervals obtained in this manner from the three streams is again octaved in a downstream processing unit OKT into the predetermined time interval BPM_REF. Following this, the octaved time interval is converted into a BPM value.

As a result, two streams BPM1 and BPM2 of bpm values are now available—one for each of two frequency ranges F1 and F2. In one prototype, the streams are retrieved with a fixed frequency of 5 Hz, and the last eight events from each of the two streams are used for statistical evaluation. At this point, a variable (event-controlled) sampling rate can also be used, wherein more than merely the last 8 events can be used, for example, 16 or 32 events.

These last 8, 16 or 32 events from each frequency band F1, F2 are combined and examined for accumulation maxima N in a downstream processing unit STAT. In the prototype version, an error interval of 1.5 bpm is used, that is, provided events differ from one another by at least 1.5 bpm, they are regarded as associated and are added together in the weighting. In this context, the processing unit STAT determines the BPM values at which accumulations occur and how many events are to be attributed to the relevant accumulation points. The most heavily weighted accumulation point can be regarded as the local BPM measurement and provide the desired tempo value A.

In an initial further development of this method, in addition to the local BPM measurement, a global measurement is carried out, by expanding the number of events used to 64, 128 etc. With alternating rhythm patterns, in which the tempo only comes through clearly on every fourth beat, an event number of at least 128 may frequently be necessary. A measurement of this kind is more reliable, but also requires more time.

A further decisive improvement can be achieved with the following measure:

Not only the first but also the second accumulation maximum is taken into consideration. This second maximum almost always occurs as a result of triplets and may even be stronger than the first maximum. The tempo of the triplets, however, has a clearly defined relationship to the tempo of the quarter notes, so that it can be established from the relationship between the tempi of the first two maxima, which accumulation maximum should be attributed to the quarter notes and which to the triplets.

If T2=2/3*T1, then T2 is the tempo
If T2=4/3*T1, then T2 is the tempo
If T2=2/5*T1, then T2 is the tempo
If T2=4/5*T1, then T2 is the tempo
If T2=3/2*T1, then T1 is the tempo
If T2=3/4*T1, then T1 is the tempo
If T2=5/2*T1, then T1 is the tempo
If T2=5/4*T1, then T1 is the tempo A phase value P is approximated with reference to one of the two filtered, simple time intervals $T_i$ between the events, preferably with reference to those values which are filtered with the lower frequency F1. These are used for the rough approximation of the frequency of the reference oscillator.

Figure 2:
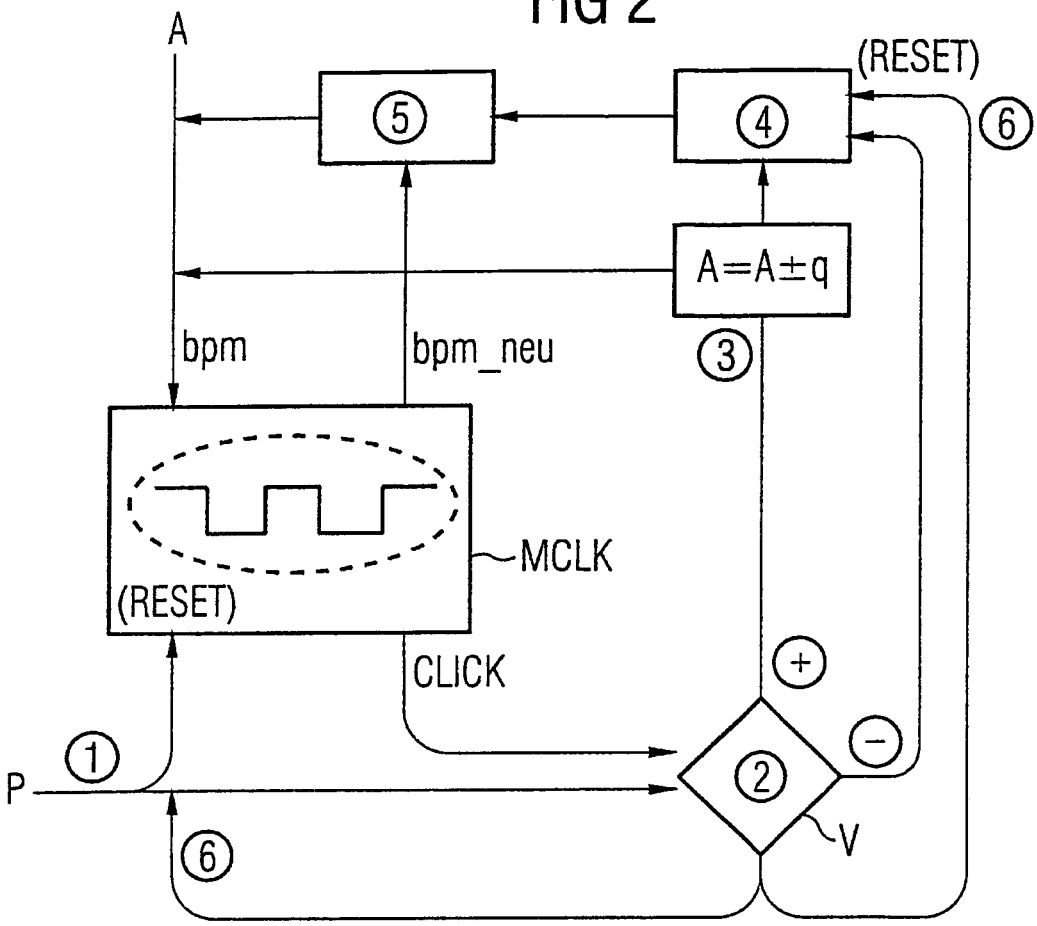
FIG. 2 shows another block circuit diagram for successive correction of the tempo and phase established.

The drawing according to FIG. 2 shows a possible block circuit diagram for successive correction of an established tempo A and phase P, referred to below as "CLOCK CONTROL".

Initially, the reference oscillator and/or the reference clock MCLK is started in an initial stage 1 with the rough phase values P and tempo values A derived from the beat detection, which is approximately equivalent to a reset of the control circuit shown in FIG. 2. Following this, in a further stage 2, the time intervals between beat events in the incoming audio signal and the reference clock MCLK are established. For this purpose, the approximate phase values P are compared in a comparator V with a reference signal CLICK, which provides the frequency of the reference oscillator MCLK.

If a "critical" deviation is systematically exceeded (+) in several successive events by a value, for example, of greater than 30 ms, the reference clock MCLK is (re)matched to the audio signal in a further processing stage 3 by means of a short-term tempo change $$A(I+1)=A(i)+q \text{ or}$$

$$A(I+1)=A(i)-q$$

relative to the deviation, wherein q represents a lowering or raising of the tempo. Otherwise (−), the tempo is held constant.

During the further sequence, in a subsequent stage 4, a summation is carried out of all correction events from stage 3 and of the time elapsed since the last "reset" in the internal memories (not shown). At approximately every $5^{th}$ to $10^{th}$ event of an approximately accurate synchronization (difference between the audio data and the reference clock MCLK approximately below 5 ms), the tempo value is re-calculated in a further stage 5 on the basis of the previous tempo value, the correction events accumulated up to this time and the time elapsed since the last reset, as follows.

With q as the lowering or raising of the tempo used in stage 3 (for example, by the value 0.1), dt as the sum of the time, for which the tempo was lowered or raised as a whole (raising positive, lowering negative), T as the time interval elapsed since the last reset (stage 1), and bpm as the tempo value A used in stage 1 the new, improved tempo is calculated according to the following simple formula:

$$\text{bpm_new}=\text{bpm}*(1+(q*dt)/T).$$

Furthermore, tests are carried out to check whether the corrections in stage 3 are consistently negative or positive over a certain period of time. If this is the case, there is probably a tempo change in the audio material, which cannot be corrected by the above procedure; this status is identified and on reaching the next approximately perfect synchronisation event (stage 5), the time and the correction memory are deleted in stage 6, in order to reset the starting point in phase and tempo. After this "reset", the procedure begins again to optimise the tempo starting at stage 2.

A synchronisation of a second piece of music now takes place by matching its tempo and phase. The matching of the second piece of music takes place indirectly via the reference oscillator. After the approximation of tempo and phase in the piece of music as described above, these values are successively matched to the reference oscillator according to the above procedure, only this time the playback phase and playback rate of the track are themselves changed. The original tempo of the track can readily be calculated back from the required change in its playback rate by comparison with the original playback rate.

The following paragraphs discuss the possibility already described above for playing back several pieces of music at the same time on a standard CD-ROM drive or another data source with only one reader unit. In this context, the present invention creates the possibility, essential for synchronising a second piece of music, of providing two or more pieces of music with a unit of this kind in real-time.

The prior art, in this context, is the playing back of an audio title from a CD-ROM by means of a computer (so-called "grabbing"), which is comparable with playing back a piece of music on a conventional CD player.

Just like audio CD players, CD-ROM drives have only one reader unit, and can therefore only read the audio data at one position at any given time.

To resolve this problem, a parallel thread, which is not coupled to the audio output is produced to act as a so-called Scheduler, which, in the background, receives requests for the pieces of music to be played back and retrospectively loads the necessary audio data.

The concept of multi-threading is understood to mean the capability of a software program to implement various functions of an application simultaneously. Accordingly, several programs are not run in parallel on the digital computer (multitasking), but, within one program, various functions are implemented at the same time from the perspective of the user. In this context, a thread represents the smallest unit of executable program code, to which one part of the operating system (the thread scheduler) allocates computer time according to a given priority. Coordination of the individual threads is carried out by means of synchronisation mechanisms, or so-called locks, which ensure the compilation of the individual threads. The reader unit, in this context the laser of the CD-ROM drive, is operated in multiplex mode, so that it can provide the necessary data in real-time by means of buffer memory strategies and a higher reading rate.

The essential technical obstacle here is that, like audio CD players, CD-ROM drives have only one reader unit available. It is therefore only possible to supply the data for one track at any given time.

This problem is resolved in that for every track to be played back, an adequately dimensioned buffer is introduced, and the higher reading rate of the CD-ROM drive is used to read out the data for the buffer. This measure fits seamlessly into the environment of the music player described. For the user, the playback of CD tracks is transparent; it occurs exactly as if the data were present in a digital format on a computer hard disk. As a result of the digital read-out from the CD, it is possible to send the audio data through signal processing means such as filters or audio effects. Amongst other factors, this allows reverse playback, pitching (changing the rate and level of pitch, beat detection and filtering of normal audio CDs.

Figure 3:
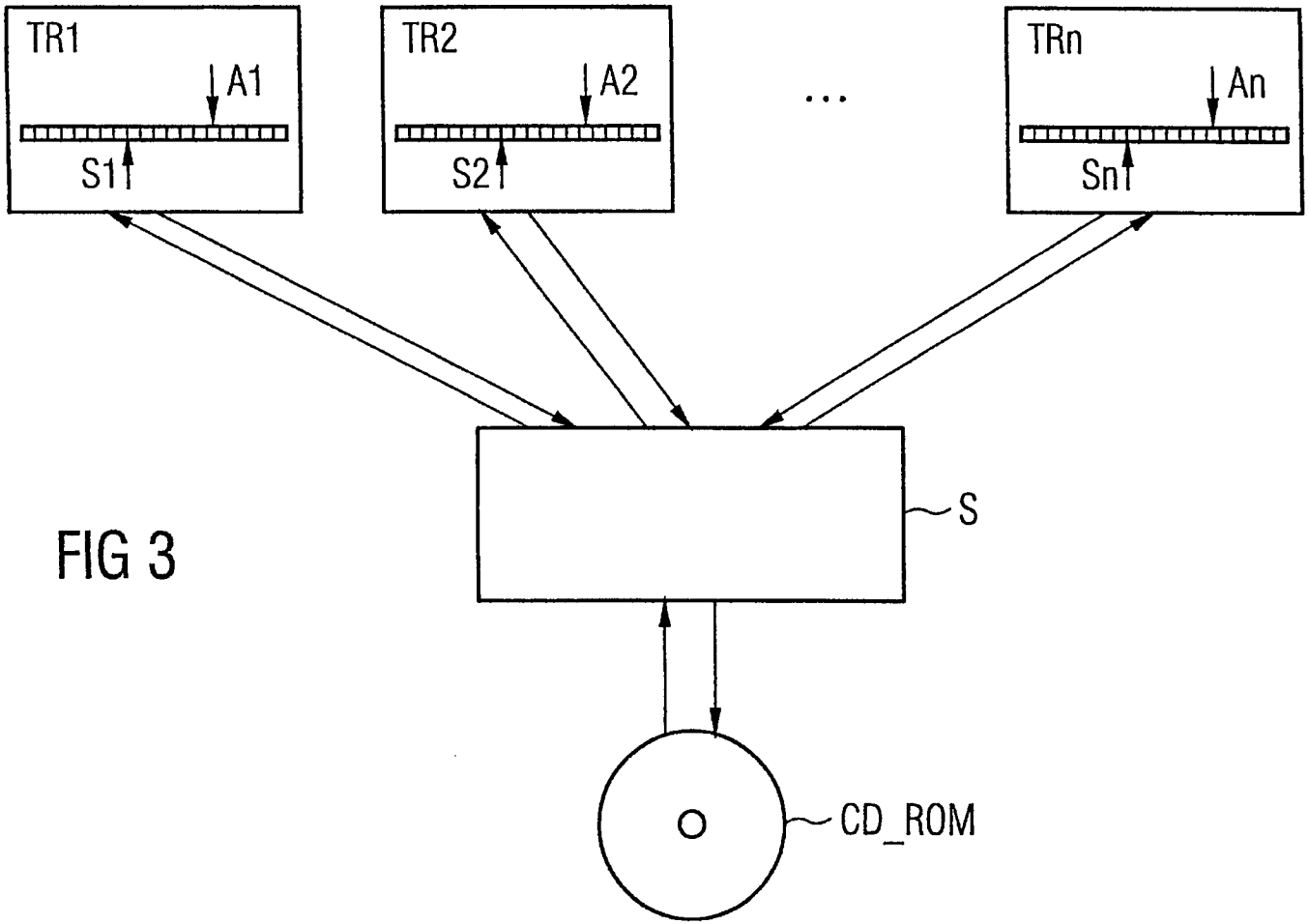
FIG. 3 shows a block circuit diagram to illustrate the set-up for parallel reading of a CD-ROM drive according to the invention.

The drawing according to FIG. 3 shows the basic design of the set-up for parallel reading of a CD-ROM drive according to the invention. The essential stage consists in the introduction of a buffer P1 . . . P2 (preferably a ring buffer) for each audio track to be played back TR1 . . . TRn. In this context, the audio data are placed in intermediate buffers in such a manner that, starting from the relevant data start S1 . . . Sn, data are still available, in the case of ring buffers, before and after each relevant current playback position A1 . . . An. A monitoring mechanism always holds this invariant constant by checking the status of the relevant buffer P1 . . . Pn to see how many data are still available. If this value falls below the threshold value (e.g. if less than n seconds of audio data are available after the current playback position), a request will be made to a central instance S to load new audio data.

This central instance, referred to below as the Scheduler S, is not coupled to the actual playback of the audio track TR1 . . . TRn, it runs in its own thread and sorts the requests received, sometimes in parallel, from various tracks into an order which is to be worked through sequentially. The scheduler S now sends the requests for an excerpt from a track to the CD-ROM drive CD-ROM. This reads the requested sectors from a data medium with the corresponding digital audio data. The scheduler S then fills the corresponding buffer P . . . Pn with the data received; data which are no longer required are over-written.

Various storage media such as vinyl discs, compact discs or cassettes are conventionally used to play back pre-recorded music on appropriate devices. These formats were not developed to allow intervention into the playback process allowing the music to be processed in a creative manner. However, this possibility is desirable and is, indeed, currently practised by the DJs mentioned in the introduction in spite of the limitations encountered. In this context, vinyl discs are preferred because the playback rate and position can most readily be influenced by hand.

Nowadays, however, digital formats such as audio CD and MP3 are predominantly used for storing music. MP3 represents a compression procedure for digital audio data according to the MPEG standard (MPEG 1 Layer 3). The procedure is asymmetrical, that is, coding is very much more complex than decoding. Furthermore, it is a procedure associated with loss. The present invention allows the above-named creative processing of music in any digital format using an appropriately interactive music player, which utilises the new possibilities created by the measures according to the invention as described above.

In order to make targeted interventions, it is important to have a graphic representation of the music, in which the current playback position can be identified as well as a certain period in the future and in the past. For this purpose, an amplitude-envelope-curve of the sound-wave form over a period of several seconds before and after the playback position is conventionally displayed. The display moves in real-time at the rate at which the music is played.

In principle, the maximum amount of helpful information in the graphic display is desirable in order to allow targeted intervention. Moreover, it is desirable if interventions in the playback procedure can be made in the most ergonomic manner possible, in a manner comparable with so-called "scratching" on vinyl discs, which is understood to mean the holding and moving forwards or backwards of the turn-table during playback.

In the case of the interactive music player created by the invention, musically relevant points in time, especially beats, can be extracted from the audio signal with the beat-detector functions explained above (FIG. 1 and FIG. 2) and displayed as markings in the graphic display, e.g. on a display or on the screen of a digital computer, on which the music player is realised by means of appropriate software.

A hardware control element R1 is also provided, e.g. a button, in particular a mouse button, which allows switching between two operating modes:

a) the music is played back freely at constant tempo b) the playback position and rate are directly influenced by the user.

Mode a) corresponds to a vinyl disc, which is not touched and which rotates at the same rate as the turn-table. By contrast, mode b) corresponds to a vinyl disc, which is manually held and pushed backwards and forwards.

In one advantageous embodiment of an interactive music player, the playback rate in mode a) is further influenced by the automatic control for synchronising the beat of the music played back with another beat (cf. FIG. 1 and FIG. 2). The other beat can be produced synthetically or can be provided by another piece of music being played back at the same time.

Moreover, a further hardware control element R2 is provided. This is used in mode b) to influence the position of the disc, so to speak, and may be a continuous controller or also the computer mouse.

Figure 4:
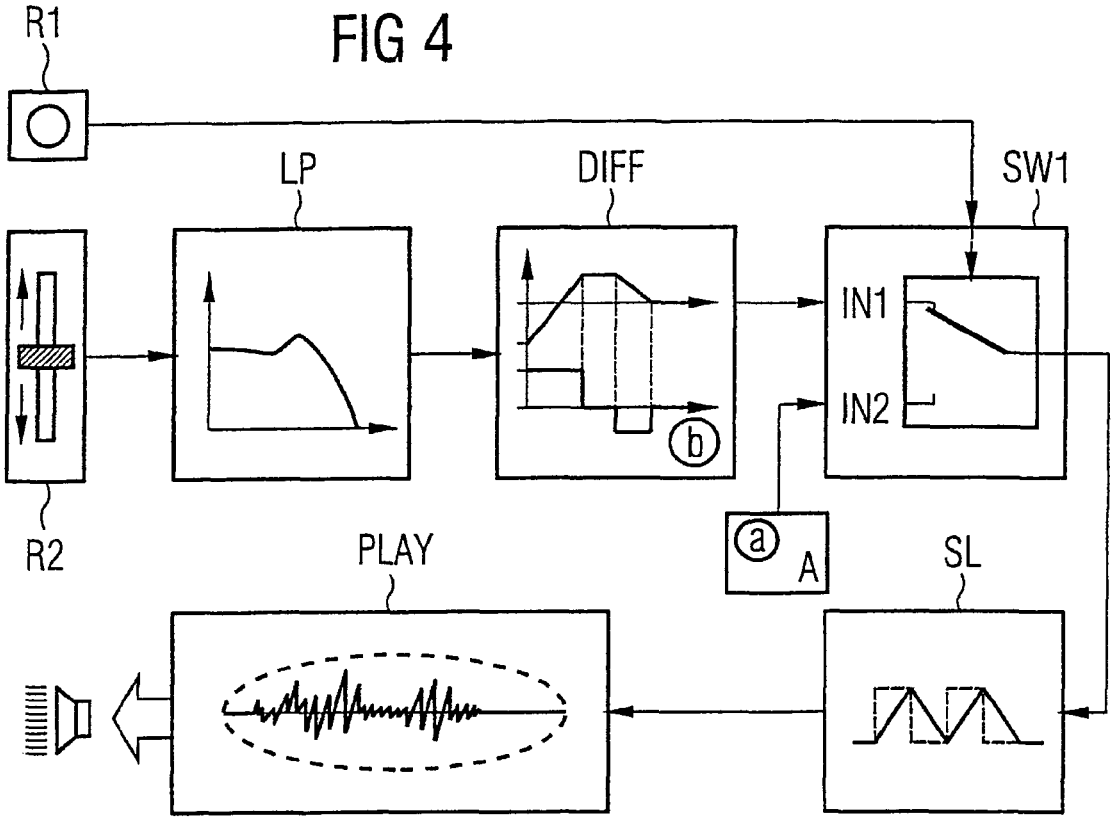
FIG. 4 shows a block circuit diagram of an interactive music player according to the invention which allows intervention in the current playback position.

The drawing according to FIG. 4 shows a block circuit diagram of an arrangement of this kind with the signal processing means explained below, which provides an interactive music player according to the invention with the possibility for intervention in the current playback position.

The position data established with this further control element R2 generally have a limited time resolution, i.e. a message indicating the current position is sent only at regular or irregular intervals. However, the playback position of the stored audio signal is supposed to change uniformly with a time resolution which corresponds to the audio sampling rate. Accordingly, the invention uses a smoothing function at this position, which produces a high-resolution, uniformly changing signal from the stepped signal defined by the control element R2.

In this context, one method is to initiate a ramp with constant gradient for every position message defined, which, within a defined time, moves the smoothed signal from its old value to the value of the position message. Another possibility is to send the stepped wave form into a linear, digital low-pass filter LP, of which the output represents the desired, smoothed signal. A 2-pole resonance filter is particularly well suited for this purpose. A combination (series connection) of the two smoothing procedures is also possible and advantageous, and this allows the following advantageous signal processing chain:

Defined stepped signal->ramp smoothing->low-pass filter->exact playback position or Defined stepped signal->low-pass filter->ramp smoothing->exact playback position.

The block circuit diagram according to FIG. 4 illustrates the basic principles of one advantageous exemplary embodiment. The control element R1 (in this case a key) is used for switching between the operating modes a) and b), by triggering a switch SW1. The controller R2 (in this case a continuous slide controller) supplies the position information with a time-limited resolution. This provides an input signal to a low-pass filter LP for smoothing. The smoothed position signal is now differentiated (DIFF) and supplies the playback rate. The switch SW1 is controlled with a signal to an initial input IN1 (mode b). The other input IN2 is provided with the tempo value A, which can be established as described in FIG. 1 and FIG. 2 (mode a). Switching between input signals is implemented via the control element R1.

The position must not jump when the user switches from one mode into the other (equivalent to holding and releasing the turn-table). For this reason, the proposed interactive music player adopts the position reached in the preceding mode as the starting position in the new mode. Similarly, the playback rate (first derivation of the position) must not change in a jumping manner. Accordingly, the current rate is also adopted and moved by means of a smoothing function, as described above, to the rate which corresponds to the new mode. According to FIG. 4, this is achieved with a Slew Limiter SL, which resolves a ramp with constant gradient, which moves the signal from its old value to the new value in a defined time. This position-dependent and/or rate-dependent signal then controls the actual playback unit PLAY for playing back the audio track, by influencing the playback rate.

During "scratching" with vinyl discs, that is to say, playback with strongly and rapidly changing playback rate, the sound-wave form changes in a characteristic manner, because of the properties of the recording method conventionally used for vinyl discs. When producing a press-master for the vinyl disc in the recording studio, the sound signal is passed through a pre-emphasis filter (pre-distortion filter) according to the RIAA standard, which raises the peaks (the so-called "cutting characteristic"). Every piece of equipment used for playing back vinyl discs contains a corresponding de-emphasis filter (reverse-distortion filter), which reverses the effect so that approximately the original signal is obtained.

Now, if the playback rate is not the same as the recording rate, which occurs, for example, during "scratching", then all the frequency components of the signal on the vinyl disc are correspondingly shifted and therefore attenuated differently by the de-emphasis filter. The characteristic sound is produced as a result.

Figure 5:
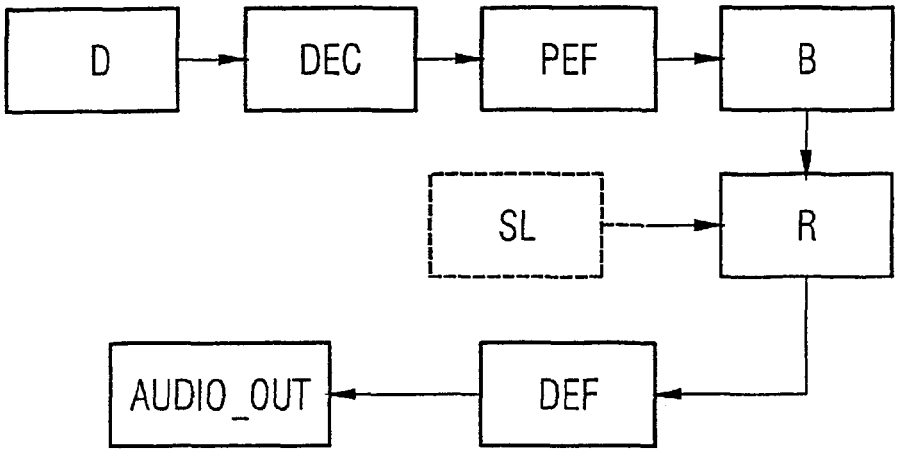

According to one further advantageous embodiment of an interactive music player according to the invention with a set-up corresponding to FIG. 4, a scratch-audio filter is provided to simulate the characteristic effect described. For this purpose, especially for a digital simulation of this procedure, the audio signal is subjected to further signal processing within the playback unit PLAY from FIG. 4, as shown in FIG. 5. After the digital audio data from the piece of music to be played back have been read from a data medium D and or sound source (e.g. CD or MP3) and (primarily in the case of the MP3) de-coded DEC, the audio signal is subjected to corresponding pre-emphasis filtering PEF. The signal which has been pre-filtered in this manner is then stored in a buffer memory B, from which it is read out in a further processing unit R at a varying rate, corresponding to the output signal from the SL, in dependence upon the operating mode a) or b), as described in FIG. 4. The signal read out is passed through a de-emphasis filter DEF before being reproduced (AUDIO_OUT).

A second-order digital IRR filter, i.e. with two favourably selected pole positions and two favourably selected zero positions is advantageously used for the pre-emphasis and de-emphasis filter PEF and DEF, which should have the same frequency response as specified in the RIAA standard. If the pole positions of one filter are the same as the zero positions of the other filter, the effect of the two filters will be increased as desired if the audio signal is played back at the original rate. In all other cases, the named filters produce the characteristic sound effect associated with "scratching". Of course, the scratching-audio filter described can also be used in conjunction with any other type of music playback device with a "scratching" function.

In combination with the suggested CD-grabbing procedure, it is also advantageous if one and the same title can be loaded twice into the interactive music player to be mixed and/or "re-mixed" with itself via the automix procedure or allowed to run as a long, one-song-mix, without ever losing the beat. In this manner, very short pieces of music can be prolonged as required by the DJ.

Moreover, the tempo of a mix can be gradually raised or lowered via a targeted frequency change of the master clock MCLK (the reference oscillator from FIG. 2) during the course of a set lasting several hours in order to achieve targeted effects for exciting or calming the public.

As already mentioned, when several pieces of music are mixed conventionally, the audio sources from sound media are played back on several playback devices and mixed via a mixing desk. With this procedure, an audio recording is restricted to recording the final result. It is therefore not possible to reproduce the mixing procedure or, at a later time, to start exactly at a predetermined position within a piece of music.

The present invention achieves precisely this goal by proposing a file format for digital control information, which provides the possibility of recording and accurately reproducing from audio sources the process of interactive mixing together with any processing effects. This is especially possible with a music player as described above.

The recording is subdivided into a description of the audio sources used and a time sequence of control information for the mixing procedure and additional effect processing.

Only the information about the actual mixing procedure and the original audio sources are required in order to reproduce the results of the mixing procedure. The actual digital audio data are provided externally. This avoids procedures involving the copying of protected pieces of music which can be problematic under copyright law. Accordingly, by storing digital control data, which relate to playback position, synchronisation information, real-time interventions using audio-signal-processing etc., mixing procedures for several audio pieces representing a mix of audio sources together with any effect processing used, can be realised as a new complete work with a comparatively long playback duration.

This provides the advantage, that a description of the processing of the audio sources is relatively short by comparison with the audio data from the mixing procedure, and the mixing procedure can be edited and re-started at any desired position. Moreover, existing audio pieces can be played back in various compilations or as longer, interconnected interpretations.

With existing sound media and music players, it has not so far been possible to record and reproduce the interaction with the user, because the known playback equipment does not provide the technical conditions required to control this accurately enough. This has only become possible as a result of the present invention, wherein several digital audio sources can be reproduced and their playback positions established and controlled. As a result, the entire procedure can be processed digitally, and the corresponding control data can be stored in a file. These digital control data are preferably stored with a resolution which corresponds to the sampling rate of the processed digital audio data.

The recording is essentially subdivided into two parts:

- a list of audio sources use, e.g. digitally recorded audio data in compressed and uncompressed form such as WAV, MPEG, AIFF and digital sound media such as a compact disk and
- the time sequence of the control information.

The list of audio sources used contains, for example:

- information for identification of the audio source
- additionally calculated information, describing the characteristics of the audio source (e.g. playback length and tempo information)
- descriptive information on the origin and copyright information for the audio source (e.g. artist, album, publisher etc.)
- meta information, e.g. additional information about the background of the audio source (e.g. musical genre, information about the artist and publisher).

Amongst other data, the control information stores the following:

- the time sequence of control data
- the time sequence of exact playback positions in the audio source
- intervals with complete status information for all control elements acting as re-starting points for playback.

The following paragraphs describe one possible example for administering the list of audio pieces in an instance in the XML format. In this context, XML is an abbreviation for Extensible Markup Language. This is a name for a meta language for describing pages in the World Wide Web. By contrast with HTML (Hypertext Markup Language), it is possible for the author of an XML document to define within the document itself certain extensions of XML in the document-type-definition-part of the document and also to use these within the same document.

```
<?xml version="1.0" encoding="ISO-8859-1"?>
<MJL VERSION="version description">
<HEAD PROGRAM="program name" COMPANY="company name"/>
<MIX TITLE="title of the mix">
<LOCATION FILE="marking of the control information file" PATH="storage location for control information file"/>
<COMMENT> comments and remarks on the mix </COMMENT>
<MIX>
<PLAYLIST>
<ENTRY TITLE="title entry 1" ARTIST="name of author" ID="identification of title">
<LOCATION FILE="identification of audio source" PATH="memory location of audio source" VOLUME="storage medium of the file"/>
<ALBUM TITLE="name of the associated album" TRACK="identification of the track on the album"/>
<INFOPLAYTIME="playback time in seconds" GENRE_ID="code for musical genre"/>
<TEMPO BPM="playback time in BPM" BPM QUALITY="quality of tempo value from the analysis"/>
<CUE POINT 1="position of the first cue point" . . . POINTn="position of the n^th cue point"/>
<FADE TIME="fade time" MODE="fade mode">
<COMMENT> comments and remarks on the audio piece>
<IMAGE FILE="code for an image file as additional commentary option"/>
<REFERENCE URL="code for further information on the audio source"/>
</COMMENT.
</ENTRY>
</ENTRY . . . >
</ENTRY>
</PLAYLIST>
</MJL>
```

The control information data, referenced through the list of audio pieces, are preferably stored in binary format. The basic structure of the stored control information in a file can be described, by way of example, as follows:

```
[Number of control blocks N]
For [number of control blocks N] is repeated }
[time difference since the last control block in milliseconds]
[number of control blocks M]
For [number of control blocks M] is repeated {
[identification of controller]
[Controller chnannel]
[New value of the controller]
}
}
```

[identification of controller] defines a value which identifies a control element (e.g. volume, rate, position) of the interactive music player. Several sub-channels [controller channel], e.g. number of playback module, may be allocated to control elements of this kind. An unambiguous control point M is addressed with [identification of controller], [controller channel].

As a result, a digital record of the mixing procedure is produced, which can be stored, reproduced non-destructively with reference to the audio material, duplicated and transmitted, e.g. over the Internet.

Figure 6:
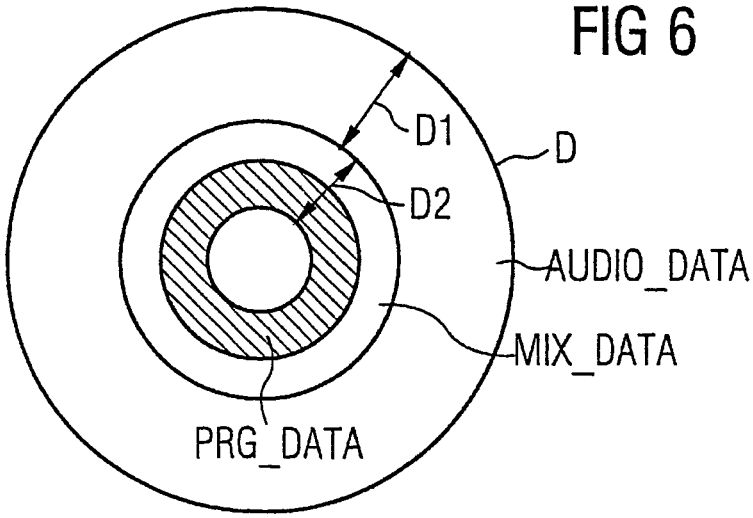
FIG. 5 shows a block circuit diagram of an additional signal processing chain which can realise a scratch-audio-filter according to the invention and FIG. 6 shows a data medium, which combines audio data and control files for the reproduction of complete works produced from the audio data according to the invention.

One advantageous embodiment with reference to such control files is a data medium D, as shown in FIG. 6. This provides a combination of a normal audio CD with digital audio data AUDIO_DATA in a first data region D1 with a program PRG_DATA disposed in a further data region D2 of the CD for playing back any mixing files MIX_DATA which may also be present, and which draw directly on the audio data AUDIO_DATA stored on the CD. In this context, the playback and/or mixing application PRG_DATA need not necessarily be a component of a data medium of this kind. The combination of a first data region D1 with digital audio information AUDIO_DATA and a second data region with one or more files containing the named digital control data MIX_DATA is advantageous, because, in combination with a music player according to the invention, a data medium of this kind contains all the necessary information for the reproduction of a new complete work created at an earlier time from the available digital audio sources.

However, the invention can be realised in a particularly advantageous manner on an appropriately programmed digital computer with appropriate audio interfaces, in that a software program executes the procedural stages of the computer system (e.g. the playback and/or mix application PRG_DATA) presented above. In combination with the advantageous CD-grabbing methods implemented on a standard CD-ROM drive, the data medium described then allows the full functionality of the invention.

Provided the known prior art permits, all of the features mentioned in the above description and shown in the diagrams should be regarded as components of the invention either in their own right or in combination.

The above description of preferred embodiments according to the invention is provided for the purpose of illustration. These exemplary embodiments are not exhaustive. Moreover, the invention is not restricted to the form exactly as indicated, indeed, numerous modifications and changes are possible within the technical doctrine indicated above. One preferred embodiment has been selected and described in order to illustrate the basic details and practical applications of the invention, thereby allowing a person skilled in the art to realise the invention. A number of preferred embodiments and further modifications may be considered in specialist areas of application.

LIST OF REFERENCE SYMBOLS

Ei event in an audio stream
Ti time interval
F1,F2 frequency bands
BD1, BD2 detectors for rhythm-relevant information
BPM_REF reference time interval
BPM_C1,
BPM_C2 processing units for tempo detection
T1*i* un-grouped time intervals
T2*i* pairs of time intervals
T3*i* groups of three time intervals
OKT time-octaving units
T1*io* . . . T3*io* time-octaved time intervals
CHK consistency testing
BPM1, BPM2 independent streams of tempo values bpm
STAT statistical evaluation of tempo values
N accumulation points
A, bpm approximate tempo of a piece of music
P approximate phase of a piece of music
1 . . . 6 procedural stages
MCLK reference oscillator/master clock
V comparator
+ phase agreement
− phase shift
q correction value
bpm_new resulting new tempo value A
RESET new start in case of change of tempo
CD-ROM audio data source/CD-ROM drive
S central instance/scheduler
TR1 . . . TRn audio data tracks
P1 . . . Pn buffer memory
A1 . . . An current playback positions
S1 . . . Sn data starting points
R1,R2 controller/control elements
LP low-pass filter
DIFF differentiator
SW1 switch
IN1, IN2 first and second input
a first operating mode
b second operating mode
SL means for ramp smoothing
PLAY player unit.
DEC decoder
B buffer memory
R reader unit with variable tempo
PEF pre-emphasis-filter/pre-distortion filter
DEF de-emphasis filter/reverse-distortion filter
AUDIO_OUT audio output
D sound carrier/data source
D1, D2 data regions
AUDIO_DATA digital audio data
MIX_DATA digital control data
PRG_DATA computer program data

What is claimed is:

1. A method for playback of digital content data, the method comprising:

providing in a first data region a control file (MIX_DATA) with digital control data for controlling a digital content data player, the digital control data representing information for controlling at least one of a mixing procedure of one or more individual pieces of content data (TR1, . . . , TRn) and an interactive intervention into the one or more individual pieces of content data (TR1, . . . , TRn) via signal processing means and being recorded during at least one of a previous mixing procedure or a previous interactive intervention, wherein the control data (MIX_DATA) in the first data region refer to the content data (CONTENT_DATA) in a second data region, the second data region comprising the content data (CONTENT_DATA) subdivided in the one or more individual pieces of content data (TR1, . . . , TRn), determining by means of the control data with reference to the one or more individual pieces of content data (TR1, . . . , TRn), in which manner the digital content data player plays back a defined part of the one or more individual pieces of content data (TR1, . . . , TRn), and playing back the content data (TR1, . . . , TRn) with at least one of a tempo and a phase which is different from the tempo and the phase with which the content data (TR1, . . . , TRn) has been recorded by modifying according to the control data (MIX_DATA)during play back the properties with which the content data (TR1, . . . , TRn) has been recorded.

2. The method according to claim 1, wherein at least one of the control file (MIX_DATA) and the content data (CONTENT_DATA) are provided on a CD, a DVD, a SC memory card or a hard disc.

3. The method according to claim 1, wherein the first and second data region is provided on one single storage medium.

4. The method according to claim 1, wherein the content data are at least one of audio, video, multimedia and entertainment data.

5. The method according to claim 1, wherein the one or more individual pieces of content data are at least one of pieces of music, of video, of multimedia and of entertainment content.

6. The method according to claim 1, wherein the control data with reference to the one or more individual pieces of content data (TR1, . . . , TRn) determine, in which sequence the digital content data player plays a defined part of the one or more individual pieces of content data (TR1, . . . , TRn).

7. The method according to claim 1, further comprising providing content data in real-time for at least two individual pieces of content data from a data source with only one reader unit, wherein the data source supplies content data at a faster reading rate than the relevant playback rate, in that a relevant buffer memory (P1 . . . Pn) is provided for each individual piece of content data (TR1, . . . , TRn) to be played, and that the faster reading rate is used in order to fill the relevant buffer memory (P1 . . . Pn) with associated content data in such a manner, that content data are always available in time before and after a current playback position (A1 . . . An) of the relevant piece of content data.

8. The method according to claim 7, where the buffer memory (P1 . . . Pn) is a ring buffer.

9. The method according to claim 7, where the status of each buffer memory (P1 . . . Pn) is monitored to determine whether sufficient data are available, and when the level falls below a predetermined threshold value, a central instance (S), which is not coupled to the playback of the one or more individual pieces of content data (TR1, . . . , TRn), in order to provide the necessary content data and automatically requests the required regions of content data from the data source and fills up the associated buffer memory (P1 . . . Pn) with the data obtained, wherein data which are not longer needed are over-written.

10. The method according to claim 9, where over-writing is performed during the filling up of a buffer memory (P1 . . . Pn).

11. The method according to claim 1, wherein the digital control data (MIX_DATA) in the first data region represent at least one of mixing procedures for pieces of content data and interactive interventions into pieces of content data using signal processing means to provide a new work with the content data (CONTENT_DATA) from pieces of content data in the second data region.

12. The method according to claim 11, wherein the digital control data (MIX_DATA) in the first data region represent at least one of the following procedures for creating a new work from the content data in the second region by at least one of:

controlling playback position, playback start and playback stop time;

controlling playback speed; and controlling playback volume and other signal processing means applied to the content data.

13. The method according to claim 1, wherein the central instance places requests received in parallel into an order to be worked through sequentially.

14. The method according to claim 1, wherein the control data with reference to the one or more individual pieces of content data (TR1, . . . , TRn) determine, to which point of time the digital content data player plays a defined part of the one or more individual pieces of content data (TR1, . . . , TRn).

15. The method according to claim 1, wherein the digital content data player is a music player, a video player or a multimedia player.

16. A digital content data player (a) with means for accessing in a first data region a control file (MIX_DATA) with digital control data for controlling the digital content data player, wherein the digital control data represent information for controlling at least one of a mixing procedure of one or more individual pieces of content data (TR1, . . . , TRn) and an interactive intervention into the one or more individual pieces of content data (TR1, . . . , TRn) via signal processing means, the digital control data being recorded during at least one of a previous mixing procedure or a previous interactive intervention, and (b) with means for accessing in a second data region the content data (CONTENT_DATA) subdivided in the one or more individual pieces of content data (TR1, . . . , TRn), wherein (c) the control data (MIX_DATA) in the first data region refer to the content data (CONTENT_DATA) in the second data region and wherein the control data with reference to the one or more individual pieces of content data (TR1, . . . , TRn) determine, in which manner the digital content data player plays a defined part of the one or more individual pieces of content data (TR1, . . . , TRn), wherein the content data (TR1, . . . , TRn) are played back with at least one of a tempo and a phase which is different from the tempo and the phase with which the content data (TR1, . . . , TRn) has been recorded by modifying according to the control data (MIX_DATA) during play back the properties with which the content data (TR1, . . . , TRn) has been recorded.

17. The digital content data player according to claim 16, wherein the digital content data player is a music player, a video player or a multimedia player.

18. A data structure, which comprises (a) a first data region with a control file (MIX_DATA) with digital control data for controlling a digital content data player, wherein the digital control data represent information for controlling at least one of a mixing procedure of one or more individual pieces of content data (TR1, . . . , TRn) and an interactive intervention into the one or more individual pieces of content data (TR1, . . . , TRn) via signal processing means, the digital control data being recorded during at least one of a previous mixing procedure or a previous interactive intervention, and (b) a second data region with the content data (CONTENT_DATA) subdivided in the one or more individual pieces of content data (TR1, . . . , TRn), wherein (c) the control data (MIX_DATA) in the first data region refer to content data (CONTENT_DATA) in the second data region and wherein the control data with reference to the one or more individual pieces of content data (TR1, . . . , TRn) determine, in which manner the digital content data player plays back a defined part of the one or more individual pieces of content data (TR1, . . . , TRn), wherein the content data (TR1, . . . , TRn) are played back with at least one of a tempo and a phase which is different from the tempo and the phase with which the content data (TR1, . . . , TRn) has been recorded by modifying according to the control data (MIX_DATA) during play back the properties with which the content data (TR1, . . . , TRn) has been recorded.

19. The data structure according to claim 18, wherein at least one of the control file (MIX_DATA) and the content data (CONTENT_DATA) are provided on a CD, a DVD, a SC memory card or a hard disc.

20. The data structure according to claim 18, which can be directly loaded into an internal memory of a computer and which comprises software sections (PRG_DATA), with which the computer assumes the functions of a digital content data player, with which, in dependence upon the control data (MIX_DATA) in the first data region, a work represented by the content data (CONTENT_DATA) can be played, when the software product (PRG_DATA) is run on the computer.

21. The data structure according to claim 18, further comprising a time sequence of control data, a time sequence of playback positions in a data source and intervals with status information for at least a part of control elements providing new starting points for playback.

22. The data structure according to claim 18, wherein the content data are at least one of audio, video, multimedia and entertainment data.

23. The data structure according to claim 18, wherein the one or more individual pieces of content data are at least one of pieces of music, of video, of multimedia and of entertainment content.

24. The data structure according to claim 18, wherein the digital content data player is a music player, a video player or a multimedia player.

25. A data medium, which comprises (a) a first data region with a control file (MIX_DATA) with digital control data for controlling a digital content data player, wherein the digital control data represent information for controlling at least one of a mixing procedure of one or more individual pieces of content data (TR1, . . . , TRn) and an interactive intervention into the one or more individual pieces of content data (TR1, . . . , TRn) via signal processing means, the digital control data being recorded during at least one of a previous mixing procedure or a previous interactive intervention, and (b) a second data region with the content data (CONTENT_ DATA) subdivided in the one or more individual pieces of content data (TR1, . . . , TRn), wherein (c) the control data (MIX_DATA) in the first data region refer to content data (CONTENT_DATA) in the second data region and wherein the control data with reference to the one or more individual pieces of content data (TR1, . . . , TRn) determine, in which manner the digital content data player plays a defined part of the one or more individual pieces of content data (TR1, . . . , TRn), wherein the content data (TR1, . . . , TRn) are played back with at least one of a tempo and a phase which is different from the tempo and the phase with which the content data (TR1, . . . , TRn) has been recorded by modifying according to the control data (MIX_DATA) during play back the properties with which the content data (TR1, . . . , TRn) has been recorded.

26. The data medium according to claim 25, wherein the digital control data (MIX_DATA) in the first data region represent at least one of mixing procedures for the one or more individual pieces of content data and interactive interventions into the one or more individual pieces of content data using signal processing means to provide a new work with the control data (CONTENT_DATA) from the one or more individual pieces of content data in the second data region.

27. The data medium according to claim 25, wherein the digital control data (MIX_DATA) in the first data region represent at least one of the following procedures for creating a new work from the content data in the second region by at least one of:

controlling playback position, playback start and playback stop time;

controlling playback speed; and controlling playback volume and other signal processing means applied to the content data.

28. The data medium according to claim 25, wherein stored digital control data (MIX_DATA) in the first data region have a format which provides information for identifying the processed one or more individual pieces of content data (TRI, . . . , TRn) in the second data region and a relevant time sequence of playback positions and status information for the control elements of the digital content data player allocated to the processed one or more individual pieces of content data.

29. The data medium according to claim 25, wherein a data structure (PRG_DATA) can be directly loaded into an internal memory of a computer and which comprises software sections (PRG_DATA), with which the computer assumes the functions of the digital content data player, with which, in dependence upon the control data (MIX_DATA) in the first data region of the data medium, which refer to the control data (CONTENT_DATA) in the second data region of the data medium, a work represented by the control data (CONTENT_ DATA) can be played, when the software product (PRG_ DATA) is run on the computer.

30. The data medium according to claim 25, wherein the data medium is realized as a CD, a DVD, a SC memory card or a hard disc.

31. The data medium according to claim 25, wherein the content data are at least one of audio, video, multimedia and entertainment data.

32. The data medium according to claim 25, wherein the one or more individual pieces of content data are at least one of pieces of music, of video, of multimedia and of entertainment content.

33. The data medium according to claim 25, wherein the digital content data player is a music player, a video player or a multimedia player.

34. A method for playback of digital content data, the method comprising:

providing in a first data region a control file (MIX_DATA) with digital control data for controlling a digital content data player, wherein the control data (MIX_DATA) in the first data region refer to content data (CONTENT_DATA) in a second data region, the second data region comprising content data (CONTENT_DATA) subdivided in one or more individual pieces of content data (TR1, . . . , TRn), and wherein the control data with reference to the one or more individual pieces of content data (TR1, . . . , TRn) determine, in which manner the digital content data player plays a defined part of the one or more individual pieces of content data (TR1, . . . , TRn);

the method further comprising providing content data in real-time for at least two individual pieces of content data from a data source with only one reader unit, wherein the data source supplies content data at a faster reading rate than the relevant playback rate, in that a relevant buffer memory (P1 . . . Pn) is provided for each individual piece of content data (TR1, . . . , TRn) to be played, and that the faster reading rate is used in order to fill the relevant buffer memory (P1 . . . Pn) with associated content data in such a manner, that content data are always available in time before and after a current playback position (A1 . . . An) of the relevant piece of content data.

35. The method according to claim 34, where the buffer memory (P1 . . . Pn) is a ring buffer.

36. The method according to claim 34, where the status of each buffer memory (P1 . . . Pn) is monitored to determine whether sufficient data are available, and when the level falls below a predetermined threshold value, a central instance (S), which is not coupled to the playback of the one or more individual pieces of content data (TR1, . . . , TRn), in order to provide the necessary content data and automatically requests the required regions of content data from the data source and fills up the associated buffer memory (P1 . . . Pn) with the data obtained, wherein data which are not longer needed are overwritten.

37. The method according to claim 36, where over-writing is performed during the filling up of a buffer memory (P1 . . . Pn).

* * * * *